United States Patent [19]

Schuck

[11] 4,318,445

[45] Mar. 9, 1982

[54] SIDE SHIFT PLOW ASSEMBLY

[75] Inventor: Paul R. Schuck, Davenport, Iowa

[73] Assignee: J. I. Case Company, Racine, Wis.

[21] Appl. No.: 179,329

[22] Filed: Aug. 18, 1980

[51] Int. Cl.[3] ..... E02F 3/85

[52] U.S. Cl. ..... 172/477; 414/695; 172/667; 172/478; 280/456 A

[58] Field of Search ..... 172/40, 667, 464, 476, 172/478, 477; 414/694, 695, 685, 705, 703; 280/456

[56] References Cited

U.S. PATENT DOCUMENTS

| | | | |
|---|---|---|---|
| 2,880,894 | 4/1959 | Walker | 414/695 |
| 3,993,206 | 11/1976 | Jomen | 414/695 |
| 4,020,745 | 5/1977 | Iijima | 414/69 S |
| 4,040,261 | 8/1977 | Schuck | 172/40 |
| 4,102,403 | 7/1978 | Steinberg | 172/40 |
| 4,113,031 | 9/1978 | Venable | 172/667 |
| 4,162,087 | 7/1979 | Avrillon | 414/705 |
| 4,239,085 | 12/1980 | Venable | 172/667 |

*Primary Examiner*—Richard J. Johnson

*Attorney, Agent, or Firm*—Cullen, Sloman, Cantor, Grauer, Scott & Rutherford

[57] ABSTRACT

An implement side shift assembly is disclosed for laterally shifting an earth-working implement relative to a tractor or the like. The side shift assembly includes a frame assembly having laterally extending upper and lower slide rails. An implement support bracket mounts the implement to the slide rails for lateral movement. A slide plate is slidably mounted between the slide rails for lateral movement, and a piston-cylinder is connected between the frame assembly and slide plate to move the slide plate laterally. A latching mechanism mounted on the implement support bracket selectively connects the slide plate to the implement support bracket at one of a plurality of connecting points on the slide plate. One of the features of the invention resides in attaching lift cylinders to the side shift frame assembly at positions as far outboard as possible on the opposite ends of the frame assembly to reduce the bending and twisting moments on the frame induced by the implement. A further feature of the invention resides in a hose tensioning device that permits a relatively large amount of hydraulic hose for the implement control cylinders to be fed out or retracted for accommodating the movement of the side shifting implement.

5 Claims, 12 Drawing Figures

66
72
74
122
114
128
130
62
66

72
146
150
138
122
148
114
130

122
150
128
114
148
146
138
130

122
114
128
62
72

SIDE SHIFT PLOW ASSEMBLY

BACKGROUND OF THE INVENTION

The present invention relates to side shift mechanisms for earth-working implements, particularly vertical plows, cable laying plows, trenchers and the like. More particularly, the present invention relates to improvements in power side shift mechanisms wherein any one of a plurality of different implement attachments may be mounted on one common side shift frame.

The prior art discloses a number of side shift mechanisms which are powered by fluid operated piston-cylinders and more complex drive systems, such as rack and pinion devices, etc. The prior art has several disadvantages. For impositive drive systems, the lateral shift of the implement is normally limited by the length and stroke of the piston cylinder, and where a relatively large piston-cylinder is utilized, the piston-cylinder is expensive. Positive drive systems are relatively complex, expensive, and subject to mechanical failure, particularly in earth-working environments.

Another problem with the prior art devices is that they are typically limited for use with one implement only. Thus, each implement attachment has its own side shift mechanism which is undesirable economically and means that substantial time and effort must be expended to make any changeovers.

A further problem with prior side shift mechanisms is that the lift cylinders for the main frame are typically located closer to the midpoint of the frame which results in the side shift frame being subjected to bending loads similar to those in a cantilever beam structure whenever the implement is side shifted to an outboard position on the frame. Additionally, the frame is subjected to large twisting or torsional loads from the ground engaging tool, such as a cable plow, which resists the machine's drawbar load at a point well below the surface of the ground. Thus, there has been a need for an improved mounting arrangement which induces a reaction force opposite to that induced by the implement to reduce both the bending moment and twisting moment imposed on the side shift frame.

During the side shifting operation, a relatively large amount of hydraulic hose is required for the implement control piston-cylinders because the hose must be fed out for accommodating the movement of the implement on the side shift frame. Thus, there has been a need for a device that automatically permits large amounts of hose to be fed out or retracted during the movement of the side shifting implement.

A power shift mechanism for earth-working implements which eliminates some of the problems of the prior art is disclosed in U.S. Pat. No. 4,113,031 to Venable assigned to the assignee of the present invention. The present invention is an improvement over U.S. Pat. No. 4,113,031 because it utilizes a laterally slidable plate in combination with a latching mechanism as described hereinbelow which permits various earth-working implements to be mounted on one common side shift frame with a relatively quick method for mounting or removing the attachments. The present invention is also an improvement over the side shift mechanism disclosed in application Ser. No. 57,769, assigned to the assignee of the present invention, because it incorporates the latching mechanism in the movable implement support frame, as will be described, to thereby further simplify the side shift operation.

SUMMARY OF THE INVENTION

The side shift mechanism of the present invention is particularly adapted to laterally shift a vertical plow, cable plow, or other earth-working implement mounted on a prime mover. In the disclosed embodiment, the prime mover includes a side shift support frame assembly, and the implement is mounted on a support bracket which is slidably supported on the side shift frame assembly. The earth-working implement may be shifted laterally relative to the prime mover by laterally shifting the implement support bracket.

In the preferred embodiment, the side shift support frame assembly includes laterally extending upper and lower slide rails which are connected to a generally rectangular frame. Each implement to be attached on the side shift frame assembly includes upper and lower support members which are attached to the implement support bracket and mount the implement on the slide rails for lateral movement of the implement relative to the prime mover. The support members have hook-like mounting portions which capture the upper and lower slide rails of the frame assembly while providing sufficient clearance to permit the implement to slide horizontally on the support frame assembly.

The hook-like mounting portion on the upper support member is removable from the support member, and removal of the hook mount permits removal of the implement from the frame assembly. Thus, it can be seen that the frame assembly and implement support bracket arrangement permit various earth-working implements such as a cable plow or other attachments to be mounted on one common side shift frame with a relatively quick method for mounting or removing the attachments.

An important feature of the present invention resides in attaching lift cylinders to the side shift frame assembly at positions as far outboard as possible on the opposite ends of the frame assembly. As described, prior constructions have had the lift cylinders located relatively close to the midpoint of the frame which has resulted in the side shift frame being subjected to substantial bending moments when the implement is side shifted to an outboard position and twisting moments from the ground engaging tool resisting the machine's drawbar load at a point well below the surface of the ground. By attaching the lift cylinders to the side shift frame at positions as far outboard as possible, reaction forces are induced at each end of the side shift frame opposite to those induced by the implement. These reaction forces reduce the bending and twisting moments on the frame induced by the implement.

Another feature of the present invention resides in the intermediate slide plate which is slidably mounted between the slide rails of the side shift frame assembly and the latching mechanism which is mounted on the implement support bracket. A piston-cylinder is connected between the frame assembly and the slide plate to move the slide plate laterally along the slide rails. A latching mechanism, mounted on the implement support bracket, selectively connects the slide plate to the implement support bracket at one of a plurality of connecting points on the slide plate.

By connecting the implement support bracket to various connecting points on the slide plate, the piston-cylinder is capable of fully laterally shifting the implement while reducing the length and stroke requirements of the piston-cylinder. In the disclosed embodiment, the stroke of the piston-cylinder may be approximately one-half the lateral shift of the implement, substantially reducing the expense of the piston-cylinder.

The latching mechanism includes a pivotal, spring-biased, latch pawl which passes through an opening in the implement support bracket to mate with an aligned detent in the slide plate. The implement is laterally shifted across the entire length of the side shift frame assembly as follows. The piston-cylinder for the slide plate is extended or retracted depending on the original location of the implement with respect to the side shift frame until the cylinder has reached the end of its stroke. The spring loaded latch pawl is released from its then engaged detent in the slide plate, thereby permitting the cylinder to be return-stroked in the opposite direction without further movement of the implement. Another detent in the slide plate is automatically re-engaged with the latch pawl when that detent passes over the latch pawl. When the slide plate is latched to the implement support bracket and the piston-cylinder is extended or retracted, the slide plate, implement support bracket, and implement attachment are moved laterally.

The spring-biased latch pawl is pivotally mounted to the movable implement support bracket and achieves its function by rotation into and out of engagement with a selected detent on the slide plate. The latch pawl includes a handle which extends vertically through an opening in the implement support bracket to a location where a flexible link may be attached which leads to the operator's station on the machine. Thus, the intermediate slide plate and associated latching mechanism provide a simple yet effective control for the side shift operation.

There are numerous advantages provided by the intermediate slide plate of the present invention. The slide plate provides a relatively flat surface which permits the mounting of a variety of implement attachments on one common side shift frame. By providing spaced apart detents on the slide plate, it may be latched to the implement support bracket at a plurality of positions which permits the stroke of the piston-cylinder to be reduced, thereby reducing the expense of the piston-cylinder. The implements attached to the side shift frame may be changed with relative ease by merely removing the hook-like mounting portion secured to the upper implement support bracket member. Other advantages in the intermediate slide plate are further disclosed herein.

Another part of the present invention resides in a hose tensioning device that permits a relatively large amount of hydraulic hose for the implement control cylinders to be fed out or retracted for accommodating the movement of the side shifting implement. The hydraulic hoses are looped through a bracket which is rotatable about a fixed pivot point depending upon the tension exerted by the hoses. The mechanism is spring loaded to rotate extra hose length away from the implement when it is positioned near the midpoint of the side shift frame. Springs are mounted to tension arms that are connected to the bracket in a manner so as to allow the mechanism to have a large amount of resisting moment at small angles of rotation and smaller amounts of resisting moment at large angles of rotation. This feature is important because the large angles of rotation occur when the implement is side shifted towards its furthest lateral position which causes the tension force exerted by the hoses to be increasingly oblique to the plane of rotation of the bracket. The mechanism cannot be forced over-center because the tension springs will interfere with the fixed pivot point and bend around it, thus creating a new line of force.

Other advantages and meritorious features of the side shift mechanism will be more fully understood from the following description of the preferred embodiment, the appended claims, and the drawings, a brief description of which follows.

DETAILED DESCRIPTION OF THE INVENTION

Figure 1:
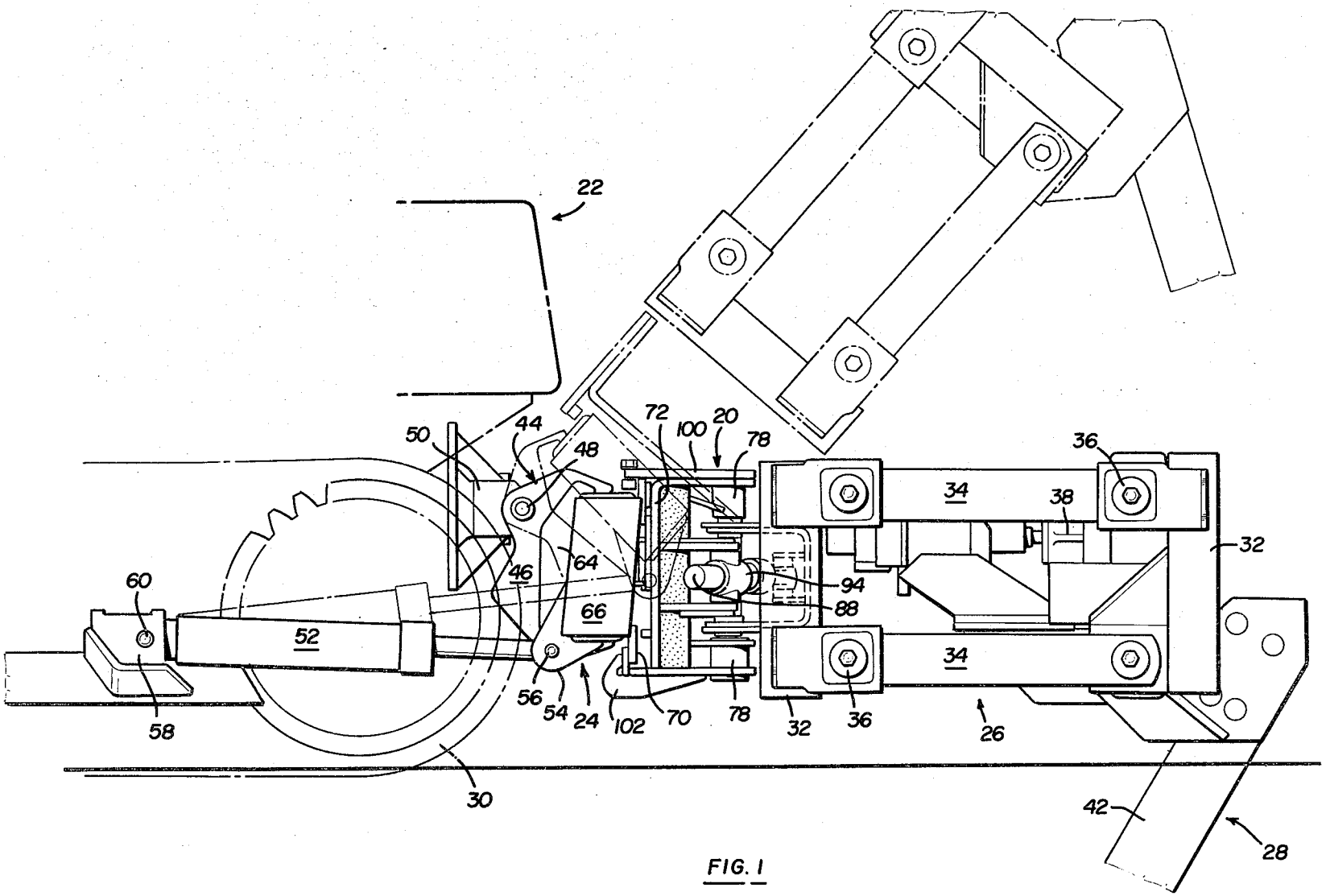
FIG. 1 is a side elevational view of a cable laying plow mounted on the side shift assembly of the present invention.
Figure 2:
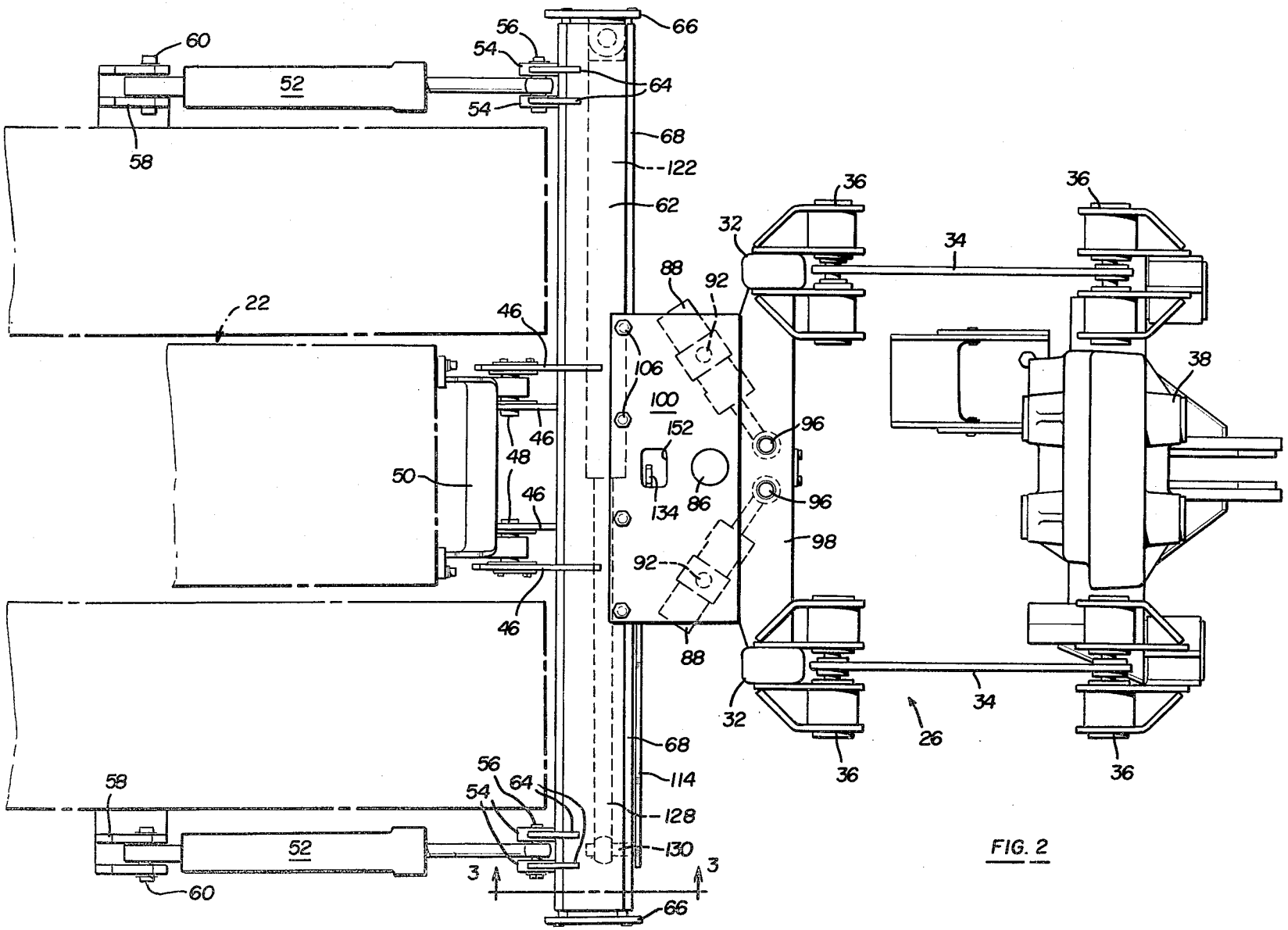
FIG. 2 is a top plan view of a cable laying plow mounted on the side shift assembly of the present invention.

FIGS. 1 and 2 illustrate an earth-working implement mounted on the side shift assembly of the present invention. It will be understood that the side shift mechanism may be used for various implements, including side shift cable plows and the like. The cable plow 20 shown in FIG. 1 includes a prime mover 22, a side shift frame assembly 24, a plow frame assembly 26, and a plow assembly 28. In the disclosed embodiment, the prime mover 22 is a conventional tractor having tracks 30. It will be understood, however, that various prime movers may be used.

The disclosed embodiment of the cable plow 20 includes a vibration isolating frame assembly 26. The frame assembly includes vertical and horizontal frame members 32 and 34, respectively, interconnected by resilient torsional bushings 36. A vibrator or shaker 38 is supported on the plow frame assembly 26 which vertically vibrates the generally vertical blade 42 of the plow assembly.

The upper midpoint of side shift frame assembly 24 of the present invention is mounted to the prime mover 22 by frame assembly 44 as illustrated in FIGS. 1 and 2. The frame assembly 44 includes vertical side plates 46 which are welded or otherwise secured to the side shift mechanism 24. Frame assembly 44 is secured to vehicle mounting bracket 50 by pivot pins 48.

An important feature of the present invention resides in attaching lift cylinders 52 to the side shift frame assembly 24 at positions as far outward as possible on the opposite ends of the frame assembly. Prior constructions have had the lift cylinders located relatively close to the mid-point of the frame which has resulted in the side shift frame being subjected to substantial bending moments when the implement is side shifted to an outboard position and twisting moments from the ground engaging tool resisting the machine's drawbar load at a point well below the surface of the ground. By attaching the lift cylinders 52 to the side shift frame 24 at positions as far outboard as possible, reaction forces are induced at each end of the side shift frame opposite to those induced by the implement. These reaction forces reduce the bending and twisting moments on the frame induced by the implement.

The rod ends of lift cylinders 52 are attached to the opposite outboard lower ends of side shift frame assembly 24 by brackets 54 and pins 56. The opposite ends of cylinders 52 are attached to tractor 22 by brackets 58 and pins 60. Extension and retraction of lift cylinders 52 cause cable plow 20 to pivot about pivot pins 48 between the solid line and phantom line positions shown in FIG. 1.

If the cable plow 20 is side shifted to a lateral position, the cylinders 52 will react against side shift frame 24 to counter the bending stress on the frame induced by the transversely cantilevered implement. Similarly, cylinders 52 induce a reaction force on frame 24 opposite to any twisting moments caused by plow blade 42 working in the ground.

Figure 3:
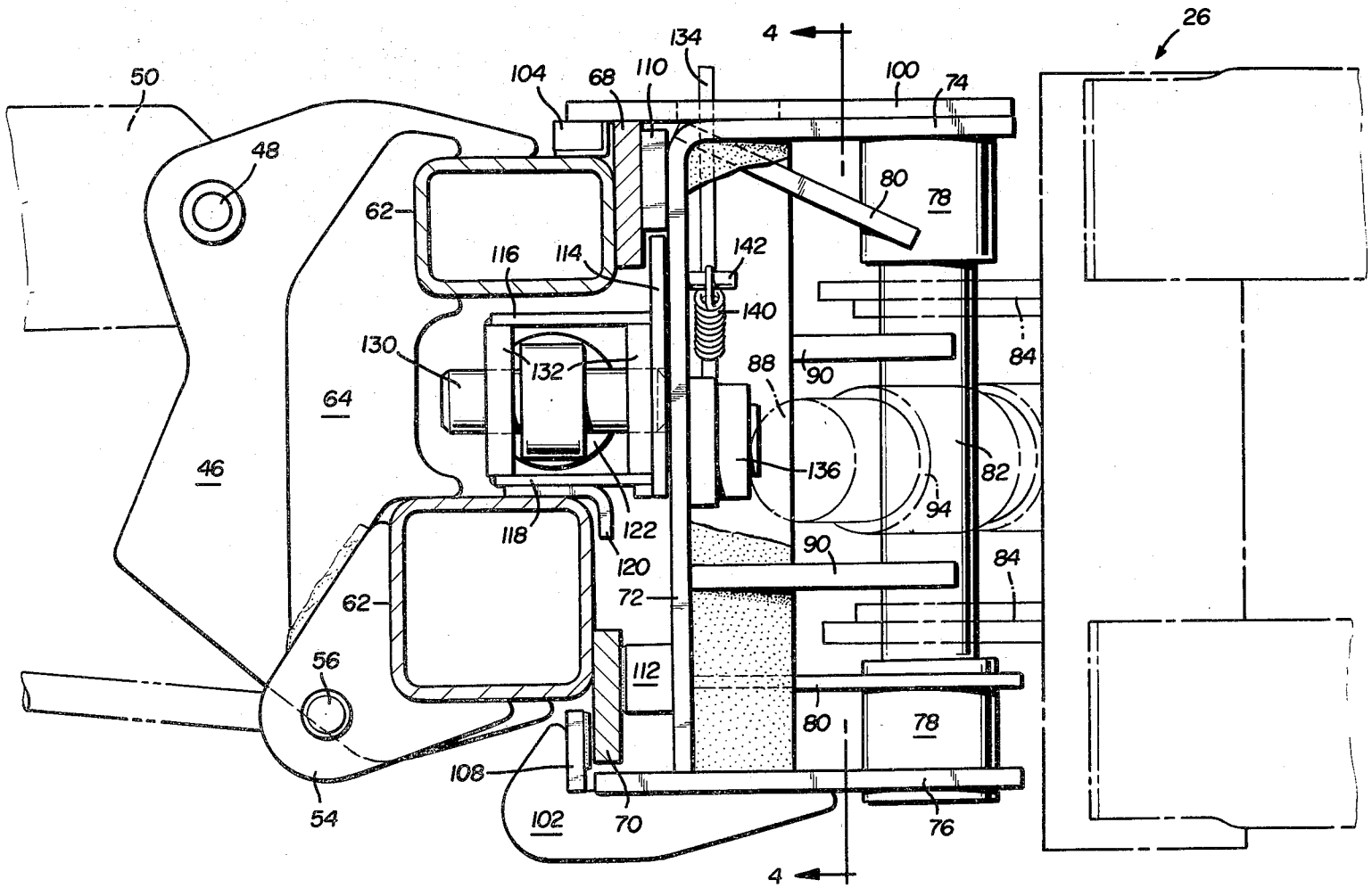
FIG. 3 is an exploded side view of the side shift mechanism of the present invention.
Figure 4:
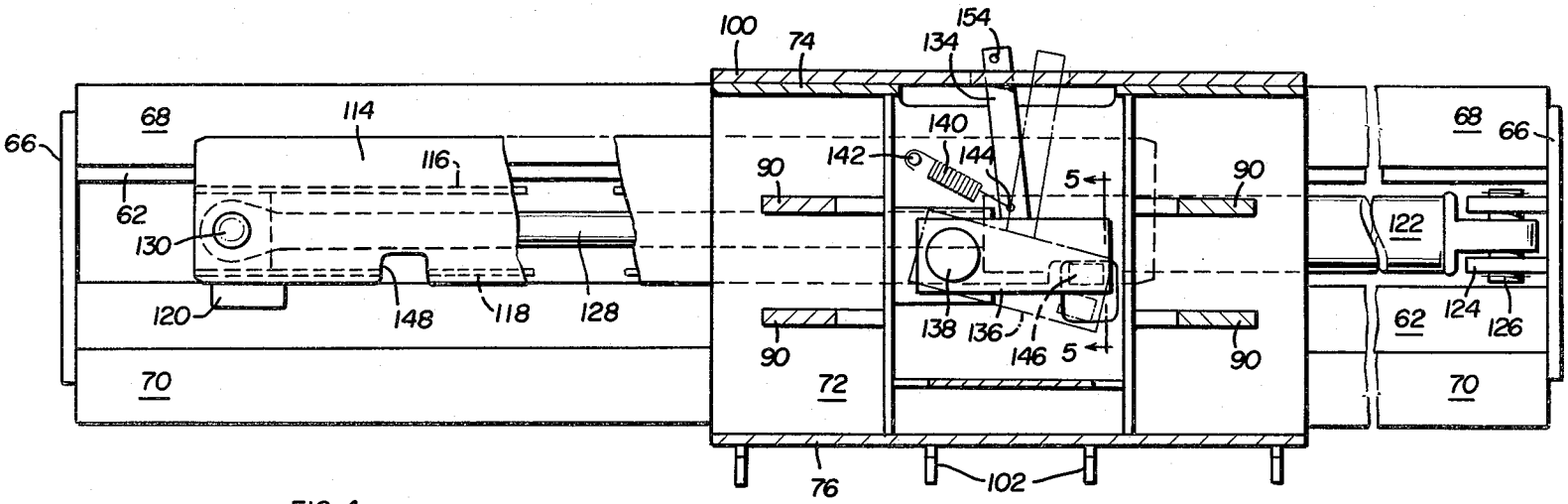
FIG. 4 is a rear view of the side shift mechanism with the implement removed and illustrating the implement support bracket, slide plate, and latching mechanism.
Figure 5:
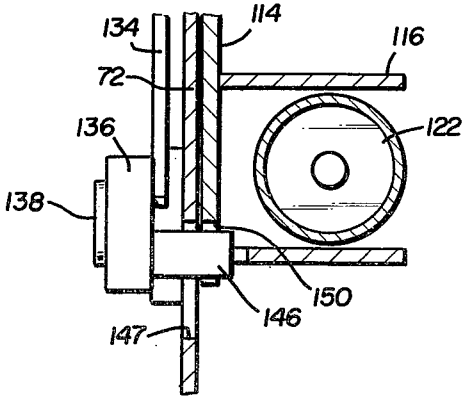
FIG. 5 is a cross-sectional view taken along line 5—5 in FIG. 4.
Figure 5A:
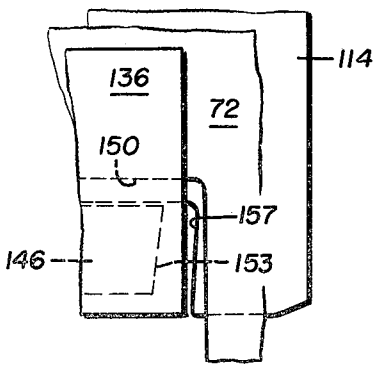
FIG. 5*a* is a detail view illustrating the preferred construction of the latch pawl and detent.

Referring to FIGS. 3–5, the side shift assembly 24 of the present invention includes a generally rectangular frame assembly including upper and lower gusset tubes 62, vertical intermediate plates 64, and end plates 66. As illustrated, the horizontal gusset tubes 62 are welded to the vertical intermediate plates 64, and plates 66 are welded to the ends thereof. Upper and lower slide rails 68 and 70 are welded or otherwise secured to the rearward ends of the gusset tubes 62. The slide rails 68 and 70 are rectangular in cross-section and form guides on which the implement attachment may be laterally shifted.

The implement mounting structure for the cable plow is illustrated in FIGS. 2 and 3. It includes a U-shaped implement support bracket 72 having an upper horizontal support leg 74 and a lower horizontal support leg 76 for pivotally supporting the cable plow assembly 26. Upper and lower pivot sleeves 78 are fixed to legs 74 and 76 and are provided with reinforcement by plates 80. A pivot sleeve 82 is mounted between upper and lower support plates 84, which extend from plow frame assembly 26, and a pivot pin 86 (FIG. 2) completes the vertical pivotal connection between plow assembly 26 and implement support bracket 72.

A pair of implement angle cylinders 88 are pivotally mounted at their cylinder ends between support legs 90 on implement support bracket 72 by pivot pins 92 and collars 94. The rod ends of cylinders 88 are pivotally attached to the horizontal frame member 98 of cable plow assembly 26 by pins 96 (FIG. 2). Selective extension and retraction of angle cylinders 88 causes plow assembly 26 to pivot about vertical pivot connection 86.

Referring to FIG. 3, the implement support bracket 72 has secured thereto an upper support member 100 and lower support members 102. A removable hook-like keeper bar 104 is suitably mounted to the implement support member 100 such as by bolts 106. A lower keeper bar 108 is fixed to the hook ends of lower support members 102. Upper and lower slide bars 110 and 112 are fixed to the exterior of implement support bracket 72 for sliding engagement with upper and lower slide rails 68 and 70, respectively.

The side shift frame assembly including the upper and lower slide rails 68 and 70, the upper and lower implement support members 100 and 102, and the hook-like keeper bars 104 and 108 permit several different implement attachments to be mounted on one common side shift frame, including the cable plow 20 illustrated in FIGS. 1 and 2. The hook-like keeper bars 104 and 108 capture the upper aand lower slide rails 68 and 70 and thereby support the implement support bracket 72 and attached implement for lateral shifting. There is provided enough clearance between the bars 104 and 108 and slide rails to permit the implement attachment to slide horizontally on the side shift frame assembly. To remove the implement attachment, it is only necessary to remove the upper keeper bar 104 and lift the implement off the upper slide rail 68. This provides a relatively quick method of mounting and de-mounting the implement attachments.

A feature of the present invention resides in the intermediate slide plate 114 which is slidable between and along the upper and lower slide rails 68 and 70. The slide plate 114 includes an upper horizontal plate 116 and a lower horizontal slide plate 118 which is supported on spaced apart arms 120 that are fixed to plate 118 and slidably supported by lower gusset tube 62 (FIGS. 3 and 4).

Referring to FIGS. 3 and 4, a side shift piston-cylinder 122 is connected at its cylinder end by bracket assembly 124 and cylinder pin 126 to vertical frame member 66. The piston rod 128 is connected to slide plate 114 by cylinder pin 130 which extends between vertical end plates 132. Extension and retraction of the side shift piston-cylinder 122 causes the slide plate 114 to shift laterally along slide rails 68 and 70.

Referring to FIGS. 3–5, a latching mechanism is disclosed for locking slide plate 114 to implement support bracket 72. The latching mechanism is controlled by an operator's control handle 134 which is fixed to control arm 136 and pivotally attached to implement support bracket 72 by pin 138. The latching mechanism is spring biased toward a detent position in slide plate 114 by coil spring 140 which is connected between bracket pin 142 and opening 144 in handle 134.

The latching mechanism includes a pivotal, spring-biased, latch pawl 146 which passes through an opening 147 in the implement support bracket 72 to mate with an aligned detent 148 or 150 in the slide plate 114. The spring-biased latch pawl 146 is pivotally mounted to the movable implement support bracket 72 and achieves its function by rotation into and out of engagement with a selected detent 148 or 150 on the slide plate 114.

Handle 134 extends vertically through opening 152 (FIG. 2) in the implement support bracket 72 to a location where a flexible link (not shown) may be attached at handle opening 154 and then extended to the operator's station on the machine thereby permitting manual release of the latching mechanism. Thus, the intermediate slide plate 114 and associated latching mechanism provide a simple yet effective control for the side shift operation.

By connecting the implement support bracket 72 to various connecting points on the slide plate 114, the piston-cylinder 122 is capable of fully laterally shifting the implement while reducing the length and stroke requirements of the piston-cylinder. The stroke of the piston-cylinder 122 may be approximately one-half the lateral shift of the implement, substantially reducing the expense of the piston-cylinder 122.

Figures 6A, 6B, 7A, 7B:
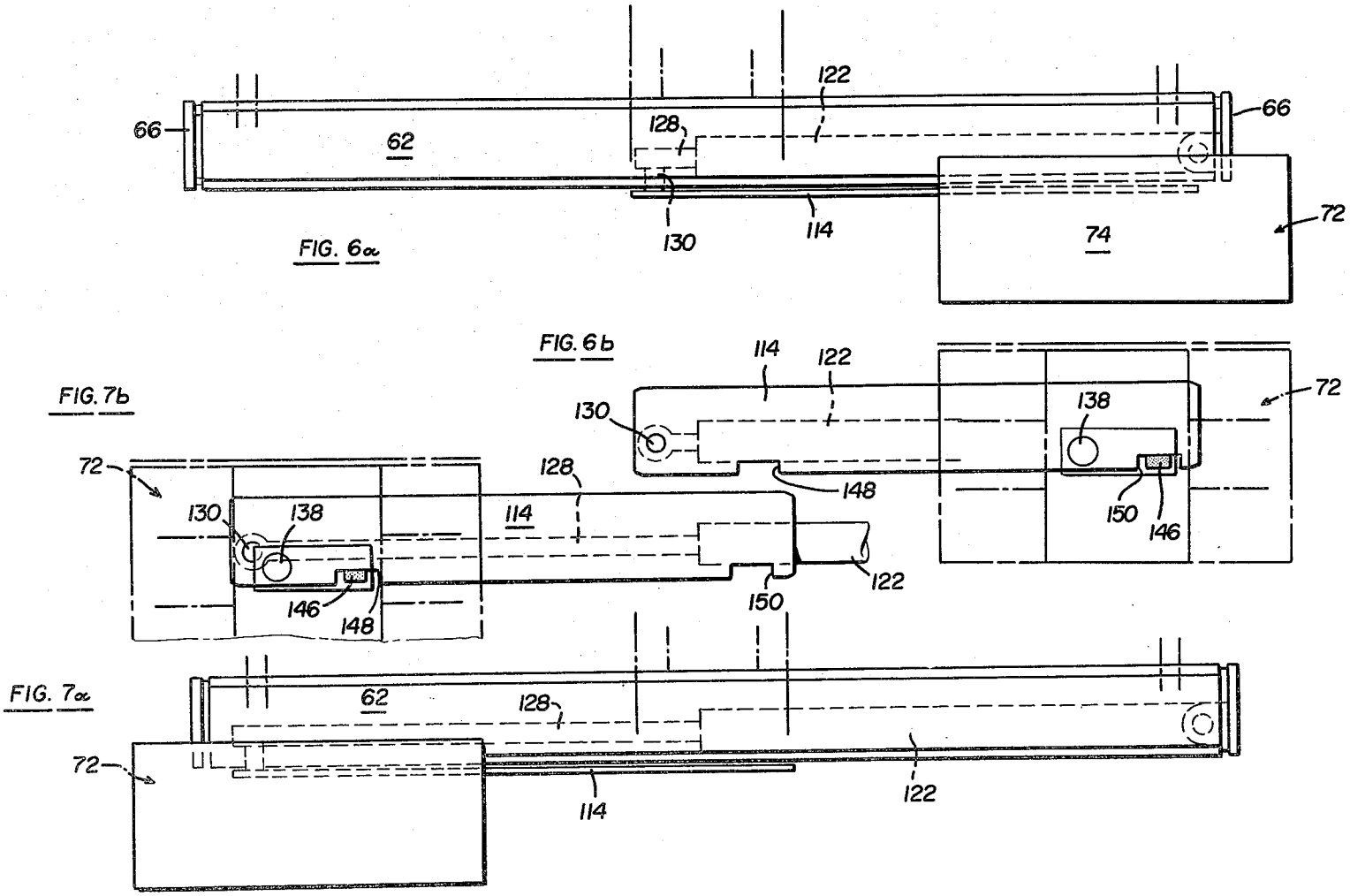
FIG. 6*a* is a schematic top plan view of the side shift mechanism with the implement support bracket secured to one of the detents in the slide plate.
FIG. 6*b* is a schematic rear view of the latched position illustrated in FIG. 6*a;*
FIG. 7*a* is a schematic top plan view illustrating the implement support bracket engaged with another detent in the slide plate.
FIG. 7*b* is a schematic rear view of the latched position illustrated in FIG. 7*a;*

FIGS. 6 and 7 illustrate the manner in which the implement is laterally shifted across the entire length of the side shift frame assembly 24. As illustrated in FIGS. *6a* and *6b*, the slide plate 114 is parallel to and of a length substantially equal to the piston-cylinder 122 in its retracted position. Slide plate detent 148 is adjacent to the pin connection 130 between piston rod 128 and slide plate 114, and detent 150 is at the opposite end of the slide plate. When spring-biased latch pawl 146 is engaged in slide plate detent 150, as shown in FIGS. *6a–b*, the extension or retraction of cylinder 122 will move the implement to the left past the center of the side shift frame and then back to the extreme right position illustrated.

The implement is side shifted on the left half of the side shift frame by first extending cylinder 122 until it has reached the end of its stroke with latch pawl 146 lockingly engaged with detent 150. Latch pawl 146 is then released from its engaged position with detent 150 by the operator's action of pulling on handle 134. This permits cylinder 122 to be return-stroked or retracted in the opposite direction without further movement of the implement. Slide plate detent 148 is automatically engaged with latch pawl 146 when it passes over the spring biased latch pawl during retraction of cylinder 122. When slide plate 114 is latched to implement support bracket 72 at detent 148, the implement may be side shifted from the center of side shift frame 24 to the left and back to center as illustrated in FIGS. *7a–b*.

If slide plate 114 is latched to implement support bracket 72 at detent 148 and side shifting on the right half of frame 24 is desired, cylinder 122 is retracted until it has reached the end of its stroke. Latch pawl 146 is then released from its engaged position with detent 148 by the operator's action of pulling on handle 134. This permits cylinder 122 to be return-stroked or extended in the opposite direction without further movement of the implement. Slide plate detent 150 is automatically engaged with latch pawl 146 when it passes over the spring biased latch pawl during extension of cylinder 122. As described, the extension or retraction of cylinder 122 in this latched position will move the implement to the left past frame center and then back to the extreme right position illustrated in FIGS. *6a–b*.

Referring to FIG. *5a*, a preferred construction is illustrated for the latch pawl 146 and aligned detent 148 or 150. The latch pawl 146 includes an inclined end 153 that is engageable with a complimentary inclined wall 157 of detent 148 or 150 when piston-cylinder 122 is actuated. The profile of latch pawl end 153 causes latch pawl 146 to rotate towards a locked position within detent 148 or 150 in response to actuation of piston-cylinder 122 which reduces the possibility of latch pawl 146 becoming disengaged from the detent during side-shift operations.

There are numerous advantages provided by the intermediate slide plate 114 and latching mechanism generally 146. The slide plate 114 provides a relatively flat surface which permits the mounting of a variety of implement attachments on one common side shift frame. By providing spaced-apart detents 148 and 150 on the slide plate 114, it may be latched to the implement support bracket 72 at a plurality of positions which permits the stroke of cylinder 122 to be reduced, thereby reducing the expense of the cylinder. By mounting the latching mechanism on the movable implement support frame 72, the present invention becomes simpler and less expensive than prior constructions and provides for a simple yet effective side shift operation.

Figures 8, 9:
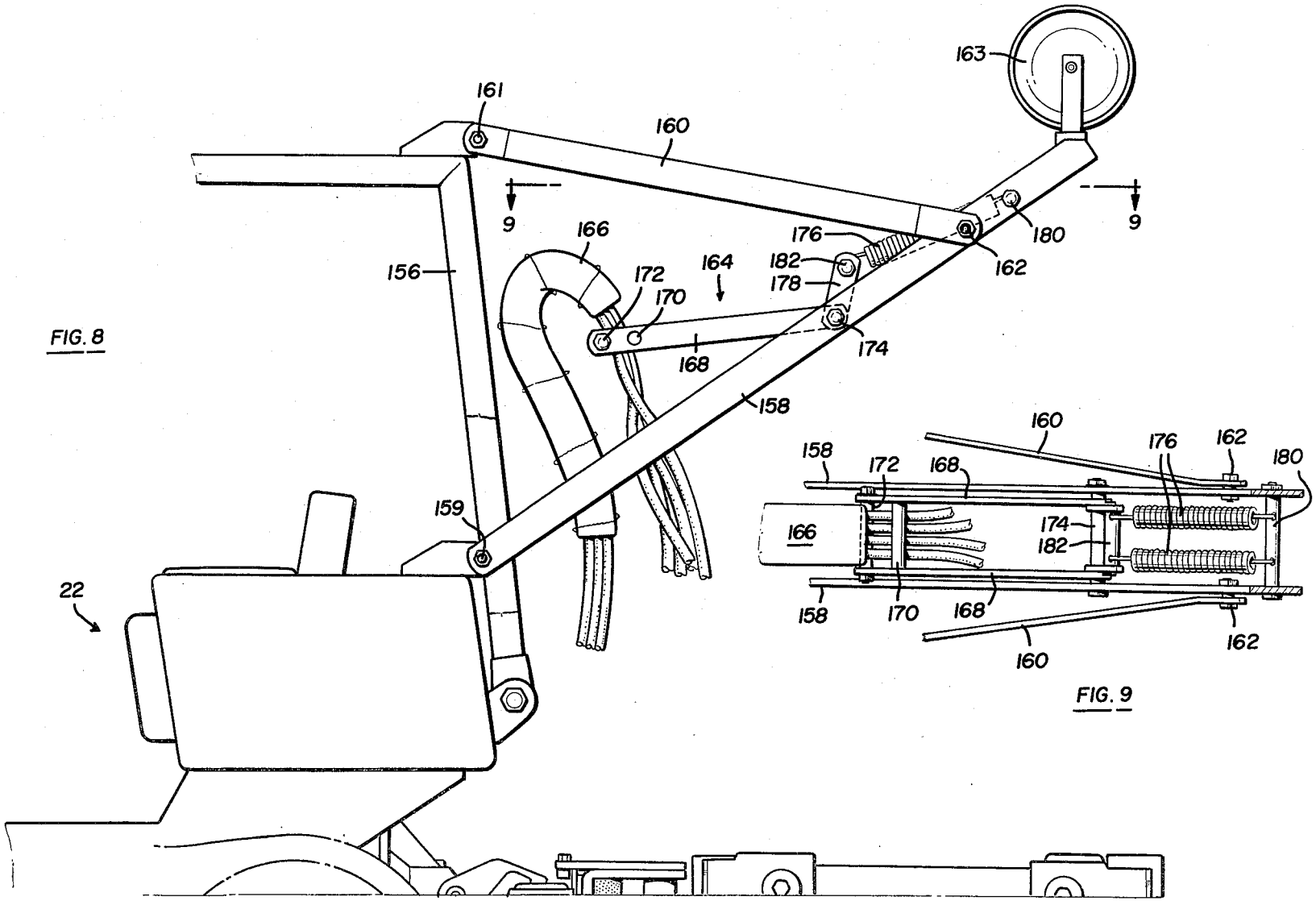
FIG. 8 is a side elevational view illustrating the hose tensioning mechanism of the present invention.
FIG. 9 is a cross-sectional view taken along line 9—9 in FIG. 8.

Another part of the present invention resides in a hose tensioning device, as illustrated in FIGS. 8 and 9, that permits a relatively large amount of hydraulic hose, for the implement control cylinders (i.e., angle cylinders 88, etc.), to be fed out or retracted for accommodating the movement of the side shifting implement. The hose tensioning device 164 is mounted adjacent the cab 156 of tractor 22 between arm supports 158. Arm supports 158 are pivotally mounted at one end to tractor 22 by pins 159 and supported in an inclined position as illustrated by support arms 160. Arms 160 are attached at one end to cab 156 by pins 161 and at their other end to arm supports 158 by pins 162. A ground cable spool 163 is attached between the free ends of arm supports 158.

The hydraulic hoses 166 are looped between transverse rollers 170 and 172 that are mounted between elongated pivotal arms 168. Arms 168 and rollers 170, 172 form a bracket assembly which is rotatable about a fixed pivot point 174 depending upon the tension exerted by the hoses. The bracket assembly 168, 170, 172 is spring loaded to rotate extra hose length away from the implement, as illustrated in FIG. 8, when the implement is near the mid point of the side shift frame 24.

As illustrated in FIG. 9, substantially shorter tension arms 178 are fixed to bracket arms 168 at a generally obtuse angle, and coil springs 176 are connected at one end to the tension arms by pin 182 and at their other ends to the transverse pin 180 extending between support arms 158. Springs 176 are mounted to tension arms 178 in a manner so as to allow the mechanism to have a large amount of resisting moment at small angles of rotation of bracket assembly 168, 170, 172 and smaller amounts of resisting moment at large angles of rotation.

This feature is important because the large angles of rotation occur when the implement is side shifted towards its furthest lateral position on the side shift frame 24 which causes the tension force exerted by hoses 166 to be increasingly oblique to the plane of rotation of the bracket assembly about pivot 174. When the implement is side shifted, the bracket assembly 168, 170, 172 and tension arms 178 are rotated counterclockwise (FIG. 8), and the effective moment arm (178) for the tension springs 176 is reduced as the line of force exerted by springs 176 moves closer to pivot point 174. The mechanism cannot be forced over center, however, because the springs 176 will interfere with pivot 174 or bend around it, thus creating a new line of force.

It will be apparent to those skilled in the art that the foregoing disclosure is exemplary in nature rather than limiting, the invention being limited only by the appended claims.

I claim:

1. A side shift assembly for a ground working implement mounted on a prime mover comprising:

a frame assembly mounted on said prime mover having laterally extending slide rails;

an implement support bracket mounting said ground working implement on said slide rails for lateral movement relative to said prime mover;

a slide plate slidably mounted between said slide rails for lateral movement relative to said slide rails;

an extensible and retractable fluid operated piston-cylinder operably connected at one end to said frame assembly and at its other end to said slide plate;

releasable latching means mounted on said implement support bracket for selectively connecting said slide plate to said implement support bracket, said slide plate having spaced apart detent portions along one edge thereof, said releasable latching means including a latch pawl rotatably mounted on said implement support bracket for selective rotation into and out of engagement with said slide plate detent portions, said latch pawl being spring biased into engagement with one of said detent portions, and a handle attached to said latch pawl for manually releasing said latch pawl from an engaged position with said one detent portion to permit slidable movement between said one edge of said slide plate and said latch pawl until said latch pawl engages another detent portion;

said implement being laterally shiftable relative to said prime mover by said side shift assembly such that when said piston-cylinder is fully retracted and said latch pawl is engaged with one of said detent portions on said slide plate, said implement being positioned on said frame assembly at a first extreme lateral position and actuation of said piston-cylinder causing said implement to move laterally in a first direction towards the center of said frame assembly and then back to the first extreme lateral position on said frame assembly; and said piston-cylinder being fully extended and said latch pawl being engaged in another of said detent portions of said slide plate whereby said implement being positioned at a second opposite extreme lateral position on said frame assembly and actuation of said piston-cylinder causing said implement to move laterally in a direction opposite to said first direction towards said center and then back to the second opposite extreme lateral position on said frame assembly.

2. The side shift assembly as defined in claim 1 wherein said slide plate being parallel to and of a length substantially equal to the length of said piston-cylinder in its fully retracted position, said one detent portion being adjacent the end of said slide plate opposite the connection point between said piston-cylinder and said slide plate, and said other detent portion being adjacent to said piston-cylinder connection point with said slide plate.

3. The side shift assembly as defined in claim 1 wherein said implement support bracket includes a removable hook means for mounting said implement to said slide rails whereby disconnecting the hook means from said support bracket permits removal of said implement from said frame assembly.

4. The side shift assembly as defined in claim 1 wherein said latch pawl including an inclined end wall which is engageable with a complementary wall of a selected detent portion upon actuation of said piston-cylinder for rotating said latch pawl towards a locked position within said detent portion.

5. The side shift assembly as defined in claim 1 including lift cylinders attached between said frame assembly and said prime mover, said lift cylinders being attached to said frame assembly at points adjacent the outboard ends of said frame assembly to reduce the bending and twisting stresses on said frame assembly induced by said ground-working implement, said frame assembly being pivotally mounted to said prime mover at a point near the center of said frame assembly and adjacent the top thereof, and said lift cylinders being attached to the lower opposed ends of said frame assembly.

* * * * *